US008613635B2

(12) United States Patent
Fisher

(10) Patent No.: US 8,613,635 B2
(45) Date of Patent: Dec. 24, 2013

(54) FLUID ACTIVATED RETRIEVAL DEVICE

(76) Inventor: Stephen J Fisher, Los Gatos, CA (US)

( * ) Notice: Subject to any disclaimer, the term of this patent is extended or adjusted under 35 U.S.C. 154(b) by 86 days.

(21) Appl. No.: 13/366,131

(22) Filed: Feb. 3, 2012

(65) Prior Publication Data

US 2012/0231685 A1 Sep. 13, 2012

Related U.S. Application Data

(60) Provisional application No. 61/464,667, filed on Mar. 7, 2011, provisional application No. 61/519,455, filed on May 23, 2011, provisional application No. 61/626,396, filed on Sep. 26, 2011.

(51) Int. Cl.
*B63B 22/06* (2006.01)

(52) U.S. Cl.
USPC ..... 441/2; 441/9; 441/23; 441/26

(58) Field of Classification Search
USPC ..... 441/2, 7, 9, 23, 26, 31
See application file for complete search history.

(56) References Cited

U.S. PATENT DOCUMENTS

| | | | | |
|---|---|---|---|---|
| 1,476,387 | A * | 12/1923 | Atwell | 441/9 |
| 2,675,568 | A | 8/1952 | King | |
| 2,785,420 | A | 6/1954 | Kanaley | |
| 2,791,785 | A | 11/1955 | Metts | |
| 2,821,725 | A | 8/1956 | Harper | |
| 3,049,733 | A | 12/1960 | Mennenga | |
| 3,982,294 | A | 9/1976 | Hicken | |
| 4,290,159 | A | 9/1981 | Konucik | |
| 4,540,370 | A | 9/1985 | Hebert | |
| 4,583,314 | A | 4/1986 | Kirkland | |
| 4,713,031 | A | 12/1987 | Fuller | |
| 4,766,690 | A | 8/1988 | Troha | |
| 5,156,562 | A | 10/1992 | Pearson | |
| 5,203,104 | A | 4/1993 | Brauer | |
| 5,219,245 | A | 6/1993 | Chin-Yee | |
| 6,332,819 | B1 | 12/2001 | Emmons | |
| 6,537,118 | B2 | 3/2003 | McAlpine | |
| 6,880,290 | B2 | 4/2005 | Mahoney | |
| 2004/0009721 | A1 | 1/2004 | Stoelinga et al. | |
| 2007/0089655 | A1 | 4/2007 | Olson et al. | |
| 2011/0078938 | A1 | 4/2011 | Aguzin | |

OTHER PUBLICATIONS

ISA/KR, International Search Report, Mar. 21, 2013, Korean IPO, 3 pp.

ISA/KR, Written Opinion of the ISA, Mar. 21, 2013, Korean IPO, 4 pp.

* cited by examiner

*Primary Examiner* — Lars A Olson
(74) *Attorney, Agent, or Firm* — Kali Law Group, PC

(57) ABSTRACT

Fluid activated retrieval devices for retrieving an object from a fluidic medium are presented including: a hollow base having a cavity formed therein, where the hollow base includes, a port disposed along an outer surface of the hollow base, the port configured to provide passage of the fluidic medium to the cavity, a diaphragm disposed along the cavity and proximate to the port, and an anchor disposed along the cavity for securing a line; a deployable float housing removably attached with the hollow base, the deployable float housing having another cavity formed therein, where the deployable float housing includes, a buoyant chamber disposed along a distal end of the other cavity, a spool for receiving the line, the spool disposed within the second cavity and attached with the deployable float housing; and a reactant disposed in the cavities.

20 Claims, 4 Drawing Sheets

FLUID ACTIVATED RETRIEVAL DEVICE

PRIORITY CLAIM TO PROVISIONAL APPLICATION

A claim for priority is hereby made under the provisions of 35 U.S.C. §119 for the present application based upon U.S. Provisional Patent Application Ser. No. 61/464,667 filed on Mar. 7, 2011 titled "UNDERWATER ACTIVATED SUBMERGED OBJECT RETRIEVAL DEVICE," and U.S. Provisional Application Ser. No. 61/519,455 filed on May 23, 2011 titled "UNDERWATER ACTIVATED SUBMERGED OBJECT RETRIEVAL DEVICE," and U.S. Provisional Application Ser. No. 61/626,396 filed on Sep. 26, 2011 titled "UNDERWATER ACTIVATED SUBMERGED OBJECT RETRIEVAL DEVICE," all three of which are incorporated herein by reference in their entirety for all that is taught and disclosed therein.

FIELD OF INVENTION

The present Applicant relates generally to retrieval devices for objects utilized in and around fluidic media.

BACKGROUND

Nearly everyone has dropped an object into water or some other fluidic medium and been unable to retrieve the object for any number of reasons. Sportsmen, for example, may spend significant time in or around water when boating or fishing. As is often the case, a fishing pole or some accessory may be inadvertently dropped in the water. The first response to dropping an object is to lunge forward to grab the object before it falls out of sight. Lunging may not be particularly desirable as the tendency to slip and injury oneself may be significant. Another response may be to enter the water to retrieve the object. However, a lone boater may be unwilling to enter the water for any number of safety related reasons.

Over time, many devices have been developed to address this problem. Manufacturing issues, reliability issues, and size issues have all contributed to prevent development of an effective device for retrieving submerged objects. As such, fluid activated retrieval devices are presented herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such, fluid activated retrieval devices for retrieving an object from a fluidic medium are presented including: a hollow base having a cavity formed therein, where the hollow base includes, a port disposed along an outer surface of the hollow base, the port configured to provide passage of the fluidic medium to the cavity, a diaphragm disposed along the cavity and proximate to the port, the diaphragm configured to selectively allow the fluidic medium to enter the cavity, and an anchor disposed along the cavity for securing a line; a deployable float housing removably attached with the hollow base, the deployable float housing having another cavity formed therein, where the deployable float housing includes, a buoyant chamber disposed along a distal end of the other cavity, a spool for receiving the line, the spool disposed within the second cavity and attached with the deployable float housing; and a reactant disposed in the cavities, the reactant responsive to the fluidic medium such that when the reactant comes into contact with the fluidic medium a reactant gas is generated.

In some embodiments, the hollow base further includes: a mating portion for mating the hollow base with the deployable float housing, the mating portion disposed along one end of the hollow base, where the mating portion includes, a mating surface, a seal disposed circumferentially along the mating surface, the seal configured to provide a fluid-tight seal between the hollow base and the deployable float housing, and a raised annular feature disposed circumferentially along the mating surface. In some embodiments, the deployable float housing further includes an annular channel disposed circumferentially along the other cavity, where the annular channel is a recessed feature having a profile suitable for receiving the raised annular feature. In some embodiments, the profile includes a sloped portion disposed along an outer edge of the annular channel.

In some embodiments, the hollow base further includes: a port passage disposed orthogonally to the at least one port, the port passage extending from the port to the outer surface. In some embodiments, the diaphragm further includes: a shore hardness in a range of approximately 40 to 80 shore; and a thickness in a range of approximately 0.01 to 0.1 inches, where the diaphragm is configured to selectively allow the fluidic medium to enter the first cavity at a pressure in a range of approximately 2 to 100 pounds per square inch (PSI). In some embodiments, the diaphragm is a material such as: a semi-flexible elastomeric compound, a flexible elastomeric compound, a silicone compound, a VITON elastomeric compound, a neoprene compound, a rubber compound, and a rubberized compound.

In some embodiments, the hollow base further includes: a strap guide disposed along the outer surface for receiving an attaching strap; and legs disposed along the outer surface for raising the fluid activated retrieval assist device from an object surface. In some embodiments, the reactant includes a mixture such as: a citric acid/sodium bicarbonate mixture, a tartaric acid/sodium bicarbonate mixture, and an acetic acid/sodium bicarbonate mixture. In some embodiments, the reactant further includes an anti-agglomeration agent compatible with the reactant. In some embodiments, the reactant further includes a desiccating agent. In some embodiments, the fluidic medium includes: an aqueous medium, a petroleum based medium, and an organic solvent medium.

BRIEF DESCRIPTION OF THE DRAWINGS

The present invention is illustrated by way of example, and not by way of limitation, in the figures of the accompanying drawings and in which like reference numerals refer to similar elements and in which.

DETAILED DESCRIPTION

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Figure 1:
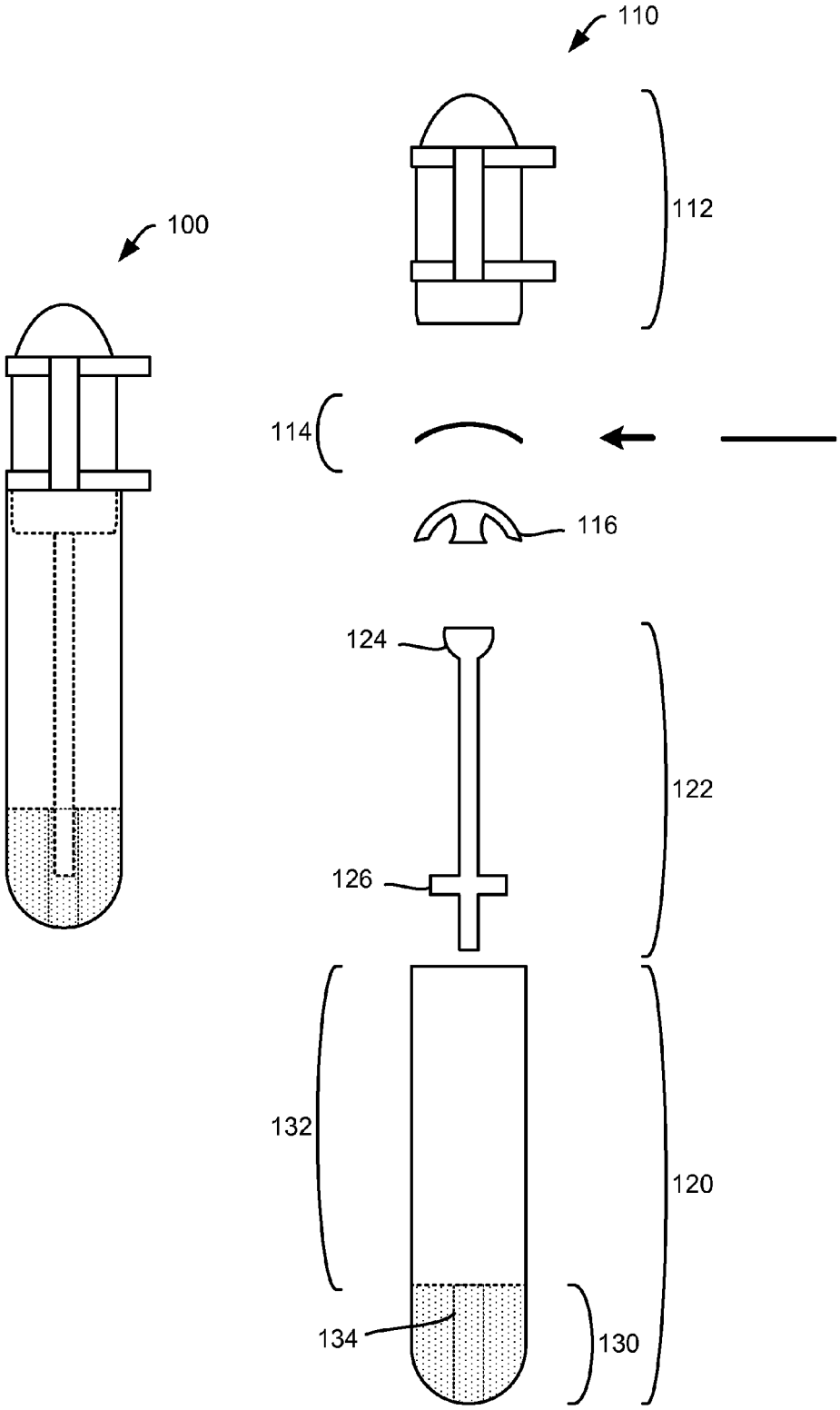
FIG. 1 is an illustrative representation of a fluid activated retrieval device in accordance with embodiments of the present invention.

FIG. 1 is an illustrative representation of a fluid activated retrieval device 100 in accordance with embodiments of the present invention. In particular, an exploded view 110 of fluid activated retrieval device 100 is illustrated for clarity in understanding embodiments disclosed herein. As illustrated, fluid activated retrieval device 100 includes several component parts or assemblies. Hollow base 112 may form a cavity into which several components may be housed including, for example, diaphragm 114 and anchor 116. Hollow base configurations will be discussed in further detail below for FIG. 2. As illustrated, diaphragm 114 may be sized to partially flex when installed in hollow base 112. The flexion provided by diaphragm embodiments, when installed properly, may serve to selectively allow fluidic media to enter the hollow base cavity whereupon the fluidic media interacts with a reactant in the hollow base cavity to produce a reactant gas. The reactant gas, in turn, produces a pressure sufficient to deploy the fluid activated retrieval device. In embodiments, the reactant gas produces a deploying pressure of at least 2-40 PSI in excess of surrounding environment pressure. Deployment of fluid activated retrieval device embodiments will be discussed in further detail below for FIG. 4.

In embodiments, the diaphragm operates to maintain equalization between the interior of fluid activated retrieval device embodiments and surrounding fluidic media thereby effectively functioning as a check valve. In embodiments, diaphragms may have a hardness in a range of approximately 40 to 80 shore. In some embodiments, diaphragms may include a thickness in a range of approximately 0.01 to 0.1 inches. In other embodiments, diaphragms may be configured to selectively allow fluidic media to enter the hollow base cavity at a pressure in a range of approximately 2 to 100 pounds per square inch (PSI). In operation, diaphragms may be configured to enable fluidic media to enter the hollow base cavity at approximately 2 to 10 PSI above the initial internal pressure of the hollow base cavity. In embodiments, the initial internal pressure of the hollow base cavity at sea level is approximately one atmosphere. In embodiments, diaphragms may be composed of materials such as: a semi-flexible elastomeric compound, a flexible elastomeric compound, a silicone compound, a VITON elastomeric compound, a neoprene compound, a rubber compound, and a rubberized compound without limitation.

Further illustrated is anchor 116 that may be housed in the hollow base cavity. Anchor 116 may be utilized to secure a line with hollow base 112. In the embodiment shown, a press-fit star washer is illustrated. However, in other embodiments, a tab, a flange, or a perforated disc may be similarly utilized without limitations. In embodiments, lines may be secured to anchors or directly with hollow base cavity in any manner known in the art such as, for example: tying, welding, gluing and otherwise bonding. Further, in embodiments, lines may be composed of any material known in the art without limitation such as, for example: a polymeric material, a braided polymeric fiber, a nylon material, a KEVLAR material, a natural fiber, and a metal fiber. A suitable line may be selected based on any of several factors including type of fluidic medium, weight of object attached with fluid activated retrieval devices, and line length requirements.

Still further as illustrated, deployable float housing 120 may be removably attached with hollow base 112 and may form a cavity into which components may be housed including, for example, spool 122. In embodiments, spool 122 may include winding stop 124 disposed along an end of spool 122 and sealing flange 126 disposed along spool 122. Winding stops may be shaped to secure lines (not shown) before deployment and to easily unwind lines during deployment. Furthermore, in embodiments, sealing flanges may be arranged to seal buoyant chamber 130 from deployable float housing cavity 134. In some embodiments, buoyant chambers are empty and rely solely on an enclosed cavity for buoyancy. In other embodiments, buoyant chambers include a buoyant material such as, for example, a closed-cell foam material, a polystyrene foam material, a STYROFOAM material, and a cork material. Still further, in some embodiments, deployable float housing 120 may include spool receiver 134 for receiving spool 122. It may be appreciated that in some embodiments, spool 122 is not configured to "spin" in order to unwind a spooled line.

Figure 2:
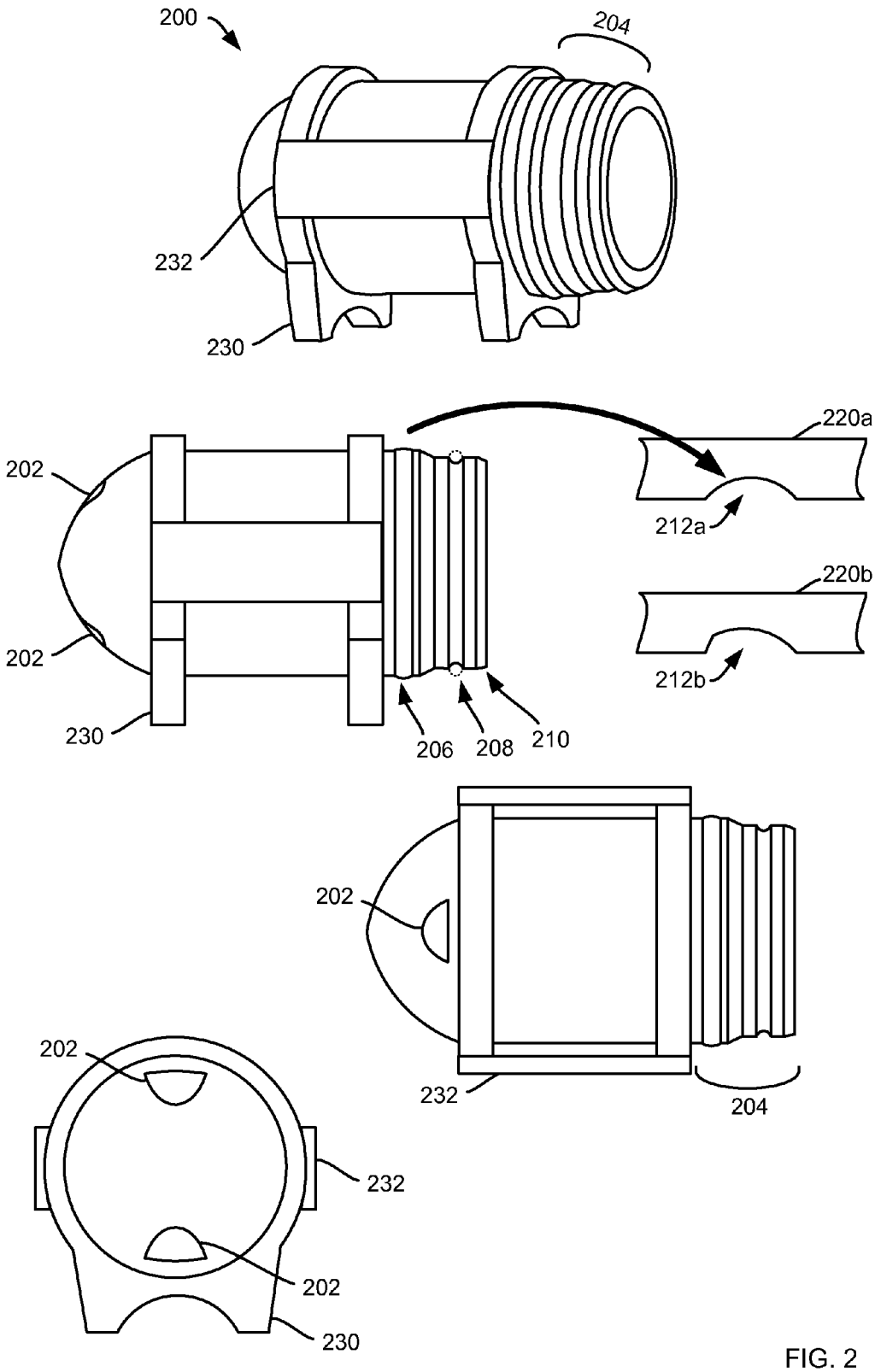
FIG. 2 is in illustrative representation of a hollow base of a fluid activated retrieval device in accordance with embodiments of the present invention.

FIG. 2 is in illustrative representation of a hollow base 200 of a fluid activated retrieval device in accordance with embodiments of the present invention. In particular, several views are provided for clarity in understanding embodiments disclosed herein. As illustrated, hollow base 200 may include several features. For example, in embodiments, hollow base 200 may include one or more ports (not shown) configured to provide passage of fluidic media to the hollow base cavity. In some embodiments, one or more port passages 202 may be disposed orthogonally to the port (not shown) extending to the outer surface of hollow base 200. In embodiments, port passages may improve resistance to clogging or fouling of ports.

Hollow base 200 may further include mating portion 204 for mating hollow base 200 with deployable float housings as provided herein. Mating portion 204 may include, in embodiments, a mating surface having a number of features. One feature illustrated is seal 208 disposed circumferentially along the mating surface in an annular channel. In embodiments, seal 208 is configured to provide a fluid-tight seal between hollow base 200 and deployable float housings. In embodiments, seals may be an O-ring configuration composed of a material suitably compatible with a selected fluidic medium. Thus, for example, in an aqueous solution, an O-ring resistant to aqueous solutions may be utilized without departing from embodiments disclosed herein. Likewise, in a petroleum solution an O-ring resistant to petroleum solutions may be utilized without departing from embodiments disclosed herein.

Another feature illustrated is raised annular feature 206 disposed circumferentially along the mating surface. Raised annular feature 206 may provide a "snap" connection with annular channel 220*a* and 220*b* disposed circumferentially along deployable float housing cavity—a portion of which is illustrated here. In embodiments, annular channel 220*a* and 220*b* include recessed features 212*a* and 212*b* respectively, each having a profile suitable for receiving the raised annular feature. As illustrated, recessed feature 212*a* has a matching profile for receiving raised annular feature 206. Further as illustrated, recessed feature 212*b* has a partially sloped profile for receiving raised annular feature 206. In this embodiment, the sloped portion of the feature may serve to "pull" raised annular feature 206 toward deployable float housing embodiments to provide an improved fitment.

Still another feature illustrated is sloped portion 210. In embodiments, sloped portion 210 may provide a guiding feature during assembly such that hollow base embodiments may be readily mated with deployable float housings embodiments. Further as illustrated, hollow base 200 is circular in cross-section. However, any number of base cross-sections may be utilized without departing from embodiments herein such as, a semicircular cross-section, an ovate cross-section, a semi-ovate cross-section, a rectangular cross section, and a semi-rectangular cross-section. In like manner, deployable float housing embodiments may include any number of housing cross-sections such as, a circular cross-section, a semicircular cross-section, an ovate cross-section, a semi-ovate cross-section, a rectangular cross section, and a semi-rectangular cross-section each selected to match base cross-sections.

In addition to mating portion 204, hollow base 200 further includes a number of legs 230. In embodiments, legs may be useful for raising fluid activated retrieval devices from an object surface to improve deployment. In some embodiments, legs may provide longitudinal alignment when, for example, fluid activated retrieval devices are mounted on a curved surface such as a fishing pole or canister. Thus, leg embodiments may include a shape suitable for mounting with any number of objects or surfaces without departing from embodiments herein. In some embodiments, legs may further include pads, coatings, tabs, holes, or any number of structures suitable for improving object mounting. Further illustrated is strap guide 232 disposed along the outer surface of the hollow base for receiving an attaching strap or tie. Other attaching configurations will be discussed in further detail below for FIG. 3.

Figure 3:
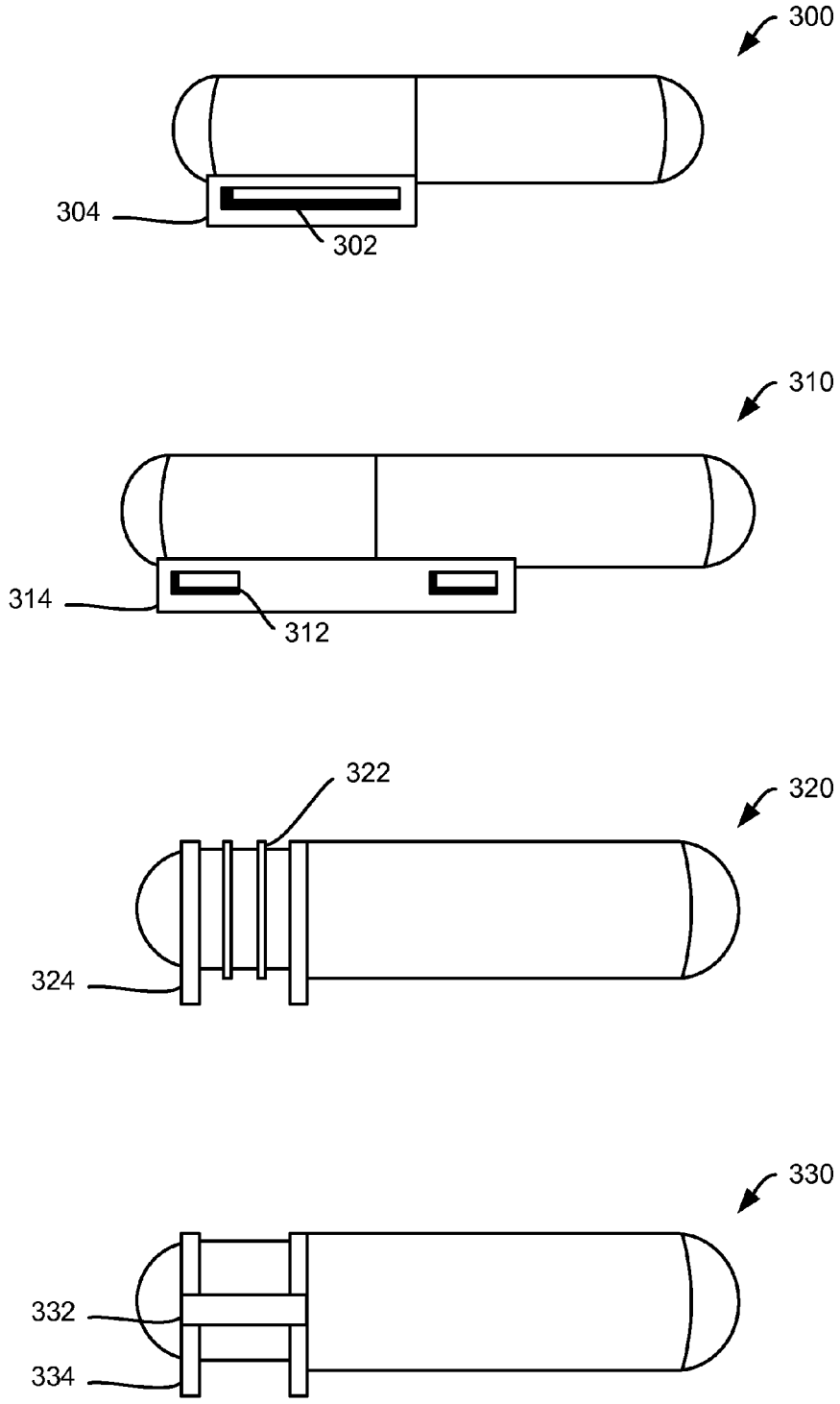
FIG. 3 illustrates representations of various fluid activated retrieval device configurations in accordance with embodiments of the present invention.

FIG. 3 illustrates representations of various fluid activated retrieval device configurations in accordance with embodiments of the present invention. In particular, FIG. 3 illustrates side views of several embodiments utilizing structures for receiving straps, ties, wire, rope, belts, or clamps to secure fluid activated retrieval devices to various objects. It may be appreciated that the figures illustrated are exemplary only and not intended to be limiting as fluid activated retrieval devices may be mounted to objects in any number of ways known in the art without departing from embodiments provided herein: that is with or without strap guides. For example, in embodiments not shown, fluid activated retrieval devices may be bonded, glued, bolted, riveted, screwed, or welded to an object without limitation. As illustrated, fluid activated retrieval device 300 includes strap guide 302 that may be integrated with leg 304 for receiving a securing element such as straps, ties, wire, rope, belts, or clamps. Further as illustrated fluid activated retrieval device 310 includes two or more strap guides 312 that may be integrated with leg 314 for receiving a securing element such as straps, ties, wire, rope, belts, or clamps. Further as illustrated fluid activated retrieval device 320 includes two or more strap guides 322 that may be utilized in combination with leg 324 for receiving a securing element such as straps, ties, wire, rope, belts, or clamps. Still further as illustrated fluid activated retrieval device 330 includes two or more strap guides 332 that may be integrated with leg 334 for receiving a securing element such as straps, ties, wire, rope, belts, or clamps.

Figure 4:
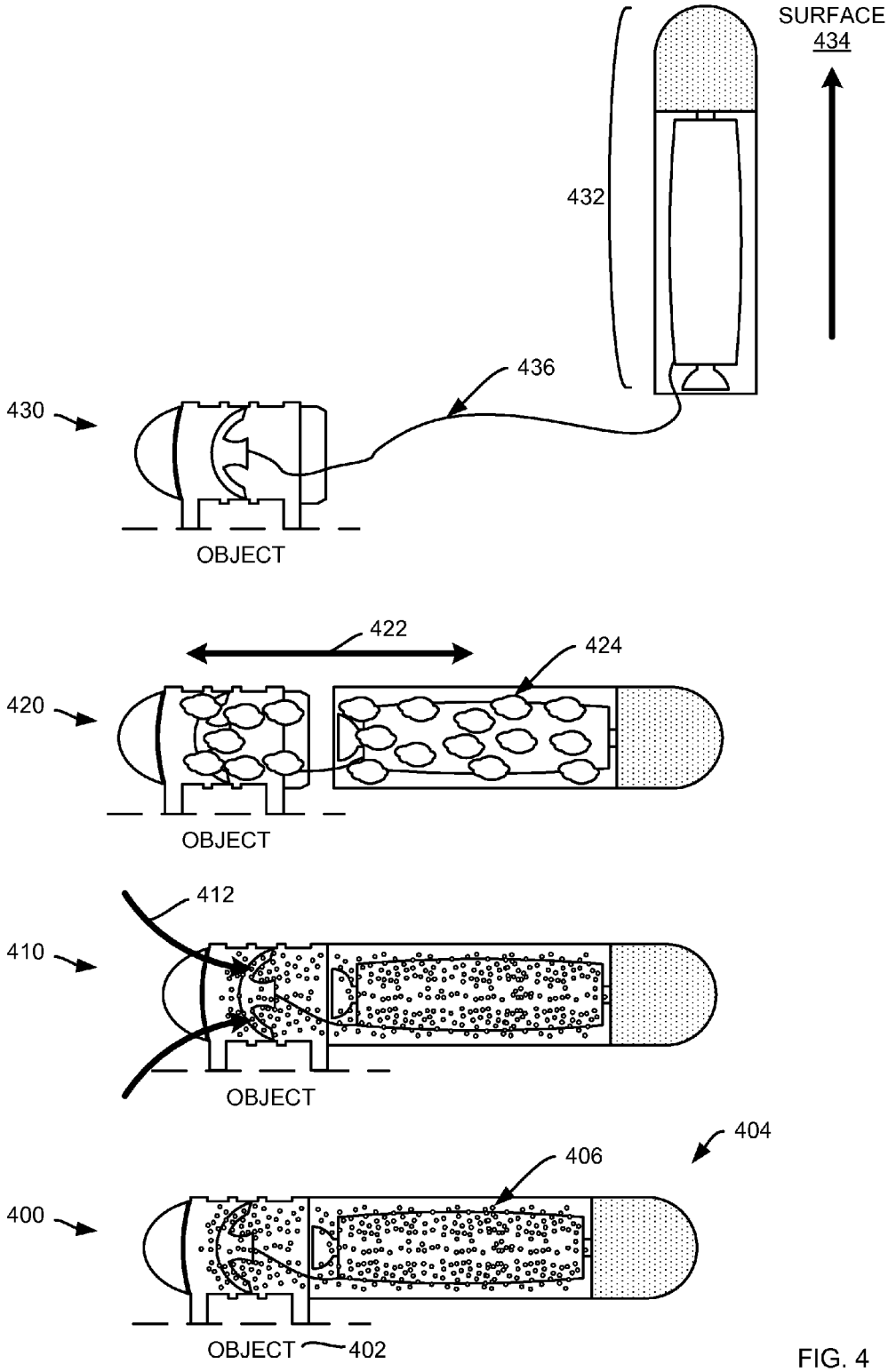
FIG. 4 is an illustrative representation of deploying a fluid activated retrieval device in accordance with embodiments of the present invention.

FIG. 4 is an illustrative representation of deploying a fluid activated retrieval device in accordance with embodiments of the present invention. At a first step 400, fluid activated retrieval device 404 is illustrated prior to deployment and mounted on object 402. Reactant 406 is illustrated as being dispersed throughout the fluid activated retrieval device. As contemplated herein, a reactant may be selected to interact with a particular fluidic medium to produce a reactant gas. In embodiments, a reactant may include a mixture such as: a citric acid/sodium bicarbonate mixture, a tartaric acid/sodium bicarbonate mixture, and an acetic acid/sodium bicarbonate mixture. In one preferred embodiments, the citric acid/sodium bicarbonate mixture includes a formula of 50% citric acid ($C_6C_8O_7$) and 50% sodium bicarbonate ($CHNaO_3$). It may be appreciated that since the reactant is dispersed through the fluid activated retrieval device an anti-agglomeration agent compatible with the reactant may be included to prevent caking in some embodiments. Still further, in some embodiments, the reactant may further include a desiccating agent to prevent unwanted reactions due to any residual humidity remaining in the fluid activated retrieval device during assembly.

At a next step 410, fluidic media 412 is represented as entering the fluid activated retrieval device 404 through port passages and ports. Fluidic media, as disclosed herein may include any number of mediums such as, an aqueous medium, a petroleum based medium, and an organic solvent medium without departing from embodiments disclosed herein. As noted above, diaphragm embodiments, when installed properly, may serve to selectively allow fluidic media to enter the hollow base cavity whereupon the fluidic media interacts with a reactant in the hollow base cavity to produce a reactant gas. At a step 420, reactant gas 424 is illustrated as having produced a pressure sufficient to deploy (422) the fluid activated retrieval device. In embodiments, the reactant gas produces a deploying pressure of at least 2-40 PSI in excess of surrounding environment pressure. Once the fluid activated retrieval device is deployed, deployable float housing 432 rises to surface 434. During the rise to the surface, line 436 is deployed. Deployable float housing 432 may then be retrieved whereupon object 402 may be retrieved.

While this invention has been described in terms of several embodiments, there are alterations, permutations, and equivalents, which fall Within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A fluid activated retrieval device for retrieving an object from a fluidic medium comprising:

a hollow base having a first cavity formed therein, wherein the hollow base includes, at least one port disposed along an outer surface of the hollow base, the at least one port configured to provide passage of the fluidic medium to the first cavity, a diaphragm disposed along the first cavity and proximate to the at least one port, the diaphragm configured to partially flex thereby selectively allowing the fluidic medium to enter the first cavity, and an anchor disposed along the first cavity for securing a line;

a deployable float housing removably attached with the hollow base, the deployable float housing having a second cavity formed therein, wherein the deployable float housing includes, a buoyant chamber disposed along a distal end of the second cavity, a spool for receiving the line, the spool disposed within the second cavity and attached with the deployable float housing, wherein the spool is configured to unwind the line without spinning; and a reactant disposed in the first and second cavities, the reactant responsive to the fluidic medium such that when the reactant comes into contact with the fluidic medium a reactant gas is generated.

2. The device of claim 1, wherein the hollow base further comprises:

a mating portion for mating the hollow base with the deployable float housing, the mating portion disposed along one end of the hollow base, wherein the mating portion includes, a mating surface, a seal disposed circumferentially along the mating surface, the seal configured to provide a fluid-tight seal between the hollow base and the deployable float housing, and a raised annular feature disposed circumferentially along the mating surface.

3. The device of claim 2, wherein the deployable float housing further includes an annular channel disposed circumferentially along the second cavity, wherein the annular channel is a recessed feature having a profile suitable for receiving the raised annular feature.

4. The device of claim 3 wherein the profile includes a sloped portion disposed along an outer edge of the annular channel.

5. The device of claim 1, wherein the hollow base further comprises:

a port passage disposed orthogonally to the at least one port, the port passage extending from the at least one port to the outer surface.

6. The device of claim 1, wherein the diaphragm further comprises:

a shore hardness in a range of approximately 40 to 80 shore; and a thickness in a range of approximately 0.01 to 0.1 inches, wherein the diaphragm is configured to selectively allow the fluidic medium to enter the first cavity at a pressure in a range of approximately 2 to 100 pounds per square inch (PSI).

7. The device of claim 6, wherein the diaphragm is a material selected from the group consisting of: a semi-flexible elastomeric compound, a flexible elastomeric compound, a silicone compound, a rubber compound, and a rubberized compound.

8. The device of claim 1, wherein the hollow base further comprises:

at least one strap guide disposed along the outer surface for receiving an attaching strap; and a least two legs disposed along the outer surface for raising the fluid activated retrieval assist device from an object surface.

9. The device of claim 1, wherein the anchor is selected from the group consisting of:

a press-fit star washer, a tab, and a perforated disc.

10. The device of claim 1, wherein the spool further comprises:

a sealing flange disposed along the spool, the sealing flange arranged to seal the buoyant chamber from the second cavity;

a winding stop disposed along an end of the spool.

11. The device of claim 1, wherein the deployable float housing further comprises a spool receiver disposed along the second cavity positioned to receive the spool.

12. The device of claim 1, wherein the buoyant chamber further comprises a buoyant material selected from the group consisting of: a closed-cell foam material, a polystyrene foam material, and a cork material.

13. The device of claim 1, wherein the reactant comprises a mixture selected from the group consisting of: a citric acid/sodium bicarbonate mixture, a tartaric acid/sodium bicarbonate mixture, and an acetic acid/sodium bicarbonate mixture.

14. The device of claim 13, wherein the reactant further comprises an anti-agglomeration agent compatible with the reactant.

15. The device of claim 13, wherein the reactant further comprises a desiccating agent.

16. The device of claim 1, wherein the reactant gas produces a deploying pressure of at least 2-40 PSI in excess of surrounding environment pressure.

17. The device of claim 1, wherein the line is a material selected from the group consisting of: a polymeric material, a braided polymeric fiber, a nylon material, a natural fiber, and a metal fiber.

18. The device of claim 1, wherein the hollow base further comprises a base cross-section selected from the group consisting of: a circular cross-section, a semicircular cross-section, an ovate cross-section, a semi-ovate cross-section, a rectangular cross section, and a semi-rectangular cross-section, and wherein the deployable float housing further includes, a housing cross-section selected from the group consisting of: a circular cross-section, a semicircular cross-section, an ovate cross-section, a semi-ovate cross-section, a rectangular cross section, and a semi-rectangular cross-section.

19. The device of claim 1, wherein the fluidic medium is selected from the group consisting of: an aqueous medium, a petroleum based medium, and an organic solvent medium.

20. A fluid activated retrieval device for retrieving an object from a fluidic medium comprising:

a hollow base having a first cavity formed therein, wherein the hollow base includes, at least one port disposed along an outer surface of the hollow base, the at least one port configured to provide passage of the fluidic medium to the first cavity, a diaphragm disposed along the first cavity and proximate to the at least one port, the diaphragm configured to selectively allow the fluidic medium to enter the first cavity, and an anchor disposed along the first cavity for securing a line;

a deployable float housing removably attached with the hollow base, the deployable float housing having a second cavity formed therein, wherein the deployable float housing includes, a buoyant chamber disposed along a distal end of the second cavity, a spool for receiving the line, the spool disposed within the second cavity and attached with the deployable float housing wherein the spool further comprises, a sealing flange disposed along the spool, the sealing flange arranged to seal the buoyant chamber from the second cavity;

a winding stop disposed along an end of the spool; and a reactant disposed in the first and second cavities, the reactant responsive to the fluidic medium such that when the reactant comes into contact with the fluidic medium a reactant gas is generated.

* * * * *